US009033335B2

(12) United States Patent
Ide et al.

(10) Patent No.: US 9,033,335 B2
(45) Date of Patent: May 19, 2015

(54) ROTATION DETECTING DEVICE, SHEET FEEDING DEVICE, AND IMAGE FORMING APPARATUS

(75) Inventors: Yasutomo Ide, Ebina (JP); Masanobu Yamagata, Kawasaki (JP); Shinichi Kato, Tama (JP); Yasuhiro Kuba, Atsugi (JP); Tsuyoshi Hashiyada, Yamato (JP)

(73) Assignee: RICOH COMPANY, LTD., Tokyo (JP)

( * ) Notice: Subject to any disclaimer, the term of this patent is extended or adjusted under 35 U.S.C. 154(b) by 1129 days.

(21) Appl. No.: 13/008,490

(22) Filed: Jan. 18, 2011

(65) Prior Publication Data

US 2011/0176819 A1 Jul. 21, 2011

(30) Foreign Application Priority Data

Jan. 19, 2010 (JP) ..... 2010-009407

(51) Int. Cl.

| | |
|---|---|
| ***B65H 1/08*** | (2006.01) |
| ***B65H 7/02*** | (2006.01) |
| ***B65H 3/06*** | (2006.01) |
| ***G03G 15/00*** | (2006.01) |

(52) U.S. Cl.

CPC .. *B65H 7/02* (2013.01); *B65H 3/06* (2013.01); *B65H 2403/42* (2013.01); *B65H 2511/212* (2013.01); *B65H 2553/25* (2013.01); *G03G 15/6502* (2013.01); *G03G 2215/00383* (2013.01); *G03G 2215/00729* (2013.01)

(58) Field of Classification Search

CPC ..... B65H 1/14; B65H 2401/115; B65H 2401/23; B65H 2553/51; G01B 5/24; G01B 7/30; G01B 5/25; G01B 5/251; G01D 5/3473; G01D 5/34738; G01D 5/252; H01H 19/005; H01H 2019/006

USPC ..... 271/147, 162

See application file for complete search history.

(56) References Cited

U.S. PATENT DOCUMENTS

| | | | | |
|---|---|---|---|---|
| 5,951,398 | A * | 9/1999 | Yamamoto et al. | 463/37 |
| 7,105,755 | B2 * | 9/2006 | Imamura | 200/11 DA |
| 7,652,217 | B2 * | 1/2010 | Asada | 200/19.18 |
| 8,322,709 | B2 * | 12/2012 | Blair et al. | 271/126 |
| 8,529,272 | B2 * | 9/2013 | Kamiya | 439/15 |
| 8,786,275 | B2 * | 7/2014 | Orrico | 324/207.25 |
| 2004/0212261 | A1 * | 10/2004 | Uchiyama | 310/68 B |

FOREIGN PATENT DOCUMENTS

| | | |
|---|---|---|
| JP | 3665201 | 4/2005 |

* cited by examiner

*Primary Examiner* — Jeremy R Severson

(74) *Attorney, Agent, or Firm* — Cooper & Dunham LLP

(57) ABSTRACT

An image forming apparatus includes a sheet feeding device (1). The sheet feeding device (1) includes a sheet feeding cassette (2), a push-up member (4), a drive shaft (5), and a rotation detecting device (6). The rotation detecting device (6) includes an output gear connected to the drive shaft (5). The output gear includes a gear main body provided with a gear tooth on its outer edge; and an electrode holding member that is attached to the gear main body. The electrode holding member is rotatably provided in the case (9) and a rotating electrode is attached to the electrode holding member. The electrode holding member is formed of at least one thermoplastic resin selected from the group consisting of POM, PA, PBT, PP, PE, ABS resin, PS, PPE, PC, and PMMA. The gear main body is formed of a material whose strength is higher than thermoplastic resin of which the electrode holding member is formed.

7 Claims, 14 Drawing Sheets

ROTATION DETECTING DEVICE, SHEET FEEDING DEVICE, AND IMAGE FORMING APPARATUS

CROSS-REFERENCE TO THE RELATED APPLICATION

This application is based on and claims the priority benefit of Japanese Patent Application No. 2010-009407, filed on Jan. 19, 2010, the contents of which are incorporated herein by reference.

BACKGROUND OF THE INVENTION

1. Field of the Invention

The present invention relates to a rotation detecting device, a sheet feeding device, and an image forming apparatus that are used for copying machines, facsimiles, printers, and the like, and more particularly, to a rotation detecting device for detecting the remaining number of recording sheets in a tray of a sheet feeding device. Also, the present invention relates to a sheet feeding device and an image forming apparatus that have such a rotation detecting device.

2. Background Art

An image forming apparatus such as a copying machine, a facsimile, and a printer stores a large volume of recording sheets, and uses a sheet feeding device for transporting the recording sheets piece by piece (for example, refer to Japanese Patent Application Laid-Open Publication No. 3665201). The sheet feeding device shown in this patent document and the like includes: a tray that is removably attached to the main body of the image forming apparatus and stores a large volume of recording sheets; a push-up member that is rotatably attached at one end to the bottom surface of the tray; a sheet feeding roller that is provided in an upper portion of the tray, and transports recording sheets to a developing device piece by piece by being rotated by the rotation driving force of a motor as a driving source; a drive shaft that is rotatably provided in the tray with an interlocking push-up member attached thereto, the interlocking push-up member being disposed between the other end of the push-up member and the bottom surface of the tray; and a rotation detecting device that is provided in the main body, and has an output gear connected to the drive shaft when the tray is set in the main body.

The rotation detecting device includes: a case; the above-described output gear rotatably supported by the case; a motor as a driving source that is housed in the case and rotates the output gear in the forward rotation direction; multiple gears that transmit the rotation driving force of the motor to the output gear; and a detecting mechanism that detects the rotation of the output gear. The output gear and the multiple gears are in mesh with each other. The output gear and the multiple gears are formed of hard material such as synthetic resin containing glass fiber, various kinds of metal, sintering material (material formed and hardened by creating bonding between particles of non-metallic or metallic powder) in order to prevent wearing of the gears in mesh with each other.

The detecting mechanism includes: a rib part projecting from the surface of the output gear; a first fixed electrode mounted on the case; a second fixed electrode mounted on the case; and a detection circuit that detects rotation of the output gear by detecting contact state between the fixed electrodes. The rib part includes cam rib pairs provided at four locations at regular intervals in the circumferential direction of the output gear, i.e., provided at every 90 degrees on the output gear. That is to say, the rib part includes a total of four cam rib pairs. The cam rib pairs each includes an inner circumference cam rib that is a projection on the output gear and extends in the circumferential direction of the output gear, and an outer circumference rib that is provided on an outer side than the inner circumference rib, and is provided on the rear side in the forward rotation direction.

The first fixed electrode is formed with a thin metal sheet and is fixed to the case in a state where the first fixed electrode is opposed to and spaced away from the surface on which the above-described inner circumference rib and outer circumference rib of the output gear are provided. The second fixed electrode includes a pair of conductive spring pieces which are provided between the first fixed electrode and the above-described surface of the output gear and arranged spaced apart from each other along the radial direction of the output gear, and which are fixed to the case. One of the spring pieces is provided between the inner circumference rib and the first fixed electrode, and the other spring piece is provided between the outer circumference rib and the first fixed electrode. When coming into contact with the inner and outer circumference ribs, these spring pieces are pressed against and come into contact with the first fixed electrode by the inner and outer circumference ribs, respectively.

The detection circuit is electrically connected to the first fixed electrode, the pair of spring pieces of the second fixed electrodes, and the like in accordance with a pre-defined pattern. The detection circuit detects a rotation angle of the output gear, i.e., rotation of the output gear by detecting a state where each spring piece of the second fixed electrodes comes into contact with the first fixed electrode, or each spring piece of the second fixed electrodes is separated from the first fixed electrode.

In the above-described rotation detecting device, when the tray is inserted into the main body of the image forming apparatus, the output gear is coupled with the drive shaft. The rotation detecting device rotates the output gear and the drive shaft in the forward rotation direction by its motor, so that the interlocking push-up member attached to this drive shaft pushes the push-up member towards the sheet feeding roller. Subsequently, when a recording sheet on the push-up member comes into contact with the sheet feeding roller, the rotation detecting device stops the rotation of the output gear and the drive shaft. In this manner, the rotation detecting device rotates the output gear and the drive shaft until a recording sheet on the push-up member comes into contact with the sheet feeding roller, and then calculates the number of recording sheets in the tray by detecting the rotation angle of the output gear at this moment with the detection circuit of the detecting mechanism. The image forming apparatus displays the number of recording sheets detected by the rotation detecting device on, e.g., a displaying unit provided on the upper portion of the main body.

Because the output gear is formed of the above-described hard materials, in the rotation detecting device shown in the above-described patent document, a bearing which rotatably supports the output gear to the case, and the above-described inner and outer circumference ribs are easily worn out due to aged deterioration. Accordingly, in the above-described rotation detecting device, "misalignment" between the output gear and the case, and between the ribs and the spring pieces of the second fixed electrode is gradually increased due to aged deterioration, thus error in detecting the rotation angle of the output gear is gradually increased naturally due to aged deterioration. Thus a problem occurs in that the number of recording sheets in the tray cannot be accurately detected.

SUMMARY OF THE INVENTION

An object of the present invention is set in view of the above background, and is to provide a rotation detecting device, a sheet feeding device, and an image forming apparatus that can accurately detect a rotation angle of the output gear for a long period of time.

To achieve the object, a rotation detecting device according to an aspect of the present invention includes: a case; an output gear rotatably supported by the case; a rotating electrode attached to the output gear; and a fixed electrode that is attached to the case and comes into contact with the rotating electrode to detect rotation of the output gear. The output gear includes: a gear main body provided with a gear tooth on an outer edge; and an electrode holding member to which the rotating electrode is attached, the electrode holding member being attached to the gear main body while being rotatably provided in the case.

The electrode holding member is formed of at least one thermoplastic resin selected from the group consisting of POM, PA, PBT, PP, PE, ABS resin, PS, PPE, PC, and PMMA. The gear main body is formed of a material whose strength is higher than the thermoplastic resin of which the electrode holding member is formed.

BRIEF DESCRIPTION OF THE DRAWINGS

FIG. 18 is a perspective view showing a mold for molding the fixing member shown in FIG. 17 and the like;

FIG. 19 is cross-sectional view of the mold shown in FIG. 18 and the like;

DETAILED DESCRIPTION OF THE PREFERRED EMBODIMENTS

Figure 1:
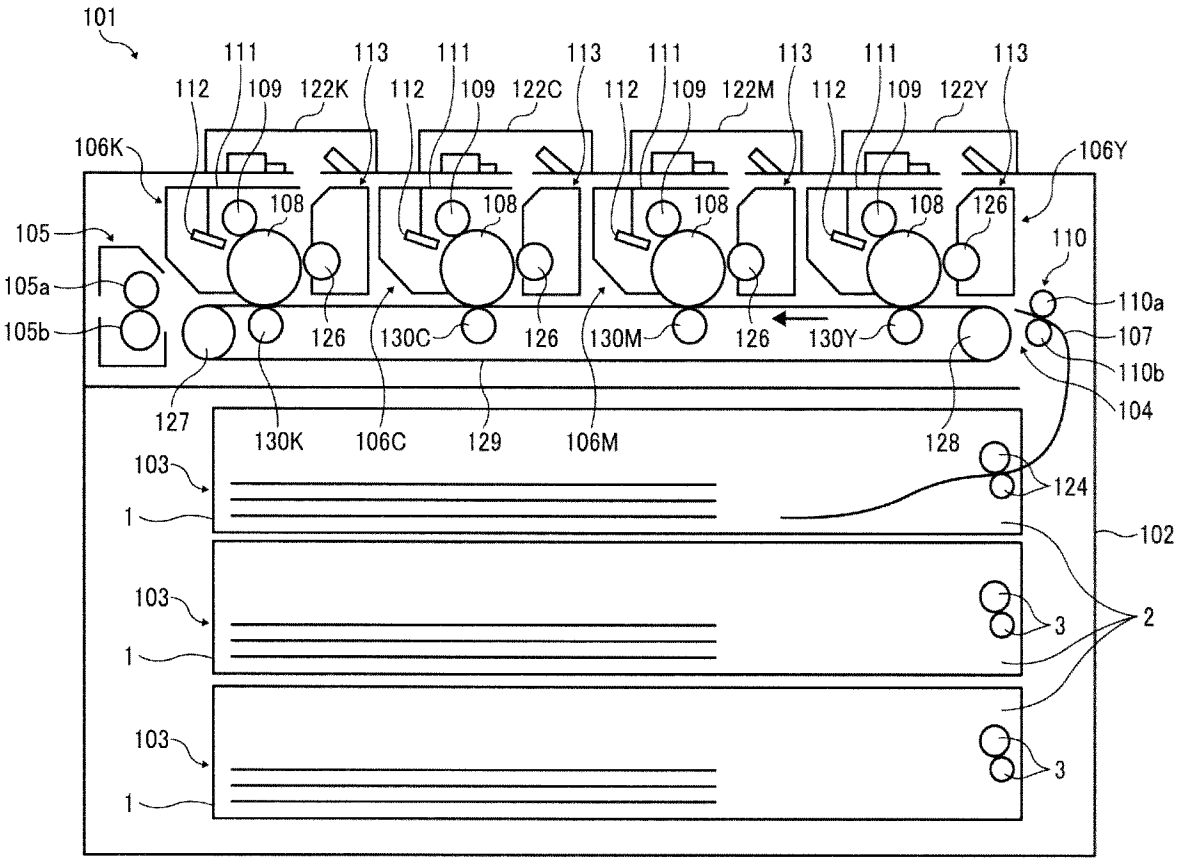
FIG. 1 is an explanatory diagram of the front view of the configuration of an image forming apparatus provided with a sheet feeding device according to one embodiment of the present invention.

In the following, one embodiment of the present invention is described in detail with reference to FIGS. 1 to 19. FIG. 1 shows the configuration of an image forming apparatus according to one embodiment of the present invention.

The image forming apparatus 101 is configured to form respective images of colors yellow (Y), magenta (M), cyan (C), black (K), i.e., color images on a recording sheet 107 as a sheet of transfer material (shown in FIG. 1). The unit corresponding to each color of yellow, magenta, cyan, black is shown by adding a suffix of Y, M, C, K to each reference symbol.

As shown in FIG. 1, the image forming apparatus 101 includes at least a main body 102, sheet feeding units 103, a resist roller pair 110, a transfer unit 104, a fixing unit 105, multiple laser writing units 122Y, 122M, 122C, 122K, and multiple process cartridges 106Y, 106M, 106C, 106K.

The main body 102 is formed, for example, in a box-like form, and is placed on a floor or the like. The main body 102 houses the sheet feeding units 103, the resist roller pair 110, the transfer unit 104, the fixing unit 105, the multiple laser writing units 122Y, 122M, 122C, 122K, and the multiple process cartridges 106Y, 106M, 106C, 106K.

The sheet feeding units 103 are provided in the lower portion of the main body 102. Each of the sheet feeding units 103 includes multiple sheet feeding devices 1. In the illustrated example, three sheet feeding devices 1 are provided and stacked in a row. The sheet feeding devices 1 house the above-described recording sheets 107 in a pile, and includes a sheet feeding cassette 2 as a tray insertable and extractable to and from the main body 102, the sheet feeding roller 3, and the like. The sheet feeding rollers 3 are pressed against the recording sheet 107 on the top in the sheet feeding cassette 2. The sheet feeding rollers 3 forward the above-described recording sheet 107 on the top into the gap between the later-described transportation belt 129 of the transfer unit 104 and the later-described photoconductive drums 108 of developing units 113 of the respective process cartridges 106Y, 106M, 106C, 106K. The detailed configuration of the sheet feeding device 1 is described later.

The resist roller pair 110 is provided in the transport path of the recording sheet 107 transported from the sheet feeding unit 103 to the transfer unit 104, and includes one pair of rollers 110*a* and 110*b*. The resist roller pair 110 inserts the recording sheet 107 between the pair of rollers 110*a* and 110*b*, and transports the inserted recording sheet 107 into the gap between the transfer unit 104 and the process cartridges 106Y, 106M, 106C, 106K at a timing of registering the inserted recording sheet 107 with a toner image.

The transfer unit 104 is provided above the sheet feeding units 103. The transfer unit 104 includes a drive roller 127, a driven roller 128, a transportation belt 129, and transfer rollers 130Y, 130M, 130C, 130K. The drive roller 127 is placed on the downstream side in the transportation direction of the recording sheet 107, and is rotated by e.g., a motor as a driving source. The driven roller 128 is rotatably supported by the main body 102, and is placed on the upstream side in the transportation direction of the recording sheet 107. The transportation belt 129 is formed in an endless ring shape, and is stretched over both the drive roller 127 and the driven roller 128 described above. The transportation belt 129 rotates (travels endlessly) in a counterclockwise direction in FIG. 1 around the above-described drive roller 127 and the driven roller 128 by rotational drive of the drive roller 127.

The transportation belt 129 and the recording sheet 107 on the transportation belt 129 are provided between the photoconductive drums 108 of the process cartridges 106Y, 106M, 106C, 106K and the transfer rollers 130Y, 130M, 130C, 130K. The transfer unit 104 transfers a toner image on the photoconductive drum 108 to the recording sheet 107 by pressing the recording sheet 107 fed from the sheet feeding unit 103 by the transfer rollers 130Y, 130M, 130C, 130K against the outer surface of the photoconductive drum 108 of each of the process cartridges 106Y, 106M, 106C, 106K. The transfer unit 104 transports the recording sheet 107, on which the toner image is transferred, to the fixing unit 105.

The fixing unit 105 is provided on the downstream side in the transportation direction of the recording sheet 107 of the transfer unit 104, and includes a pair of rollers 105*a* and 105*b* that sandwich the recording sheet 107 therebetween. The fixing unit 105 fixes the toner image transferred on the recording sheet 107 from the photoconductive drum 108 on the recording sheet 107 by pressing and heating the recording sheet 107 transported from the transfer unit 104 between the pair of rollers 105*a* and 105*b*.

The laser writing units 122Y, 122M, 122C, 122K are each attached to the upper portion of the main body 102. The laser writing units 122Y, 122M, 122C, 122K correspond to the process cartridges 106Y, 106M, 106C, 106K, respectively. The laser writing units 122Y, 122M, 122C, 122K form electrostatic latent images by emitting a laser beam to the outer surface of the photoconductive drum 108 uniformly charged by the later-described charging rollers 109 of the process cartridges 106Y, 106M, 106C, 106K.

The process cartridges 106Y, 106M, 106C, 106K are provided between the transfer unit 104 and the laser writing units 122Y, 122M, 122C, 122K. The process cartridges 106Y, 106M, 106C, 106K can be attached and detached to and from the main body 102. The process cartridges 106Y, 106M, 106C, 106K are disposed in parallel along the transportation direction of the recording sheet 107.

As shown in FIG. 1, the process cartridges 106Y, 106M, 106C, 106K each includes a cartridge case 111, the charging roller 109 as an charging device, the photoconductive drum (also referred to as an image carrier) 108, a cleaning blade 112 as a cleaning device, and a developing unit 113. Accordingly, the image forming apparatus 101 includes at least the charging roller 109, the photoconductive drum 108, the cleaning blade 112, and the developing unit 113.

The cartridge case 111 can be attached and detached to and from the main body 102, and houses the charging roller 109, the photoconductive drum 108, the cleaning blade 112, and the developing unit 113. The charging roller 109 uniformly charges the outer surface of the photoconductive drum 108. The photoconductive drum 108 is disposed spaced apart from the later-described developing roller 115 of the developing unit 113. The photoconductive drum 108 is formed in a cylindrical or tubular shape rotatable about the axis. On the outer surface of each photoconductive drum 108, an electrostatic latent image is formed by the corresponding laser writing unit 122Y, 122M, 122C, or 122K. Toner sticks to an electrostatic latent image formed and carried on the outer surface of the photoconductive drum 108, and the latent image is developed. The toner image obtained in this manner is transferred to the recording sheet 107 positioned between the transportation belt 129 and the photoconductive drums 108. The cleaning blade 112 removes toner that remains on the outer surface of the photoconductive drum 108 after transferring a toner image to the recording sheet 107.

The developing unit 113 has a developing roller 126 that causes toner as developer of a desired color to stick to the photoconductive drum 108, and develops an electrostatic latent image to form a toner image on the photoconductive drum 108.

Figure 2:
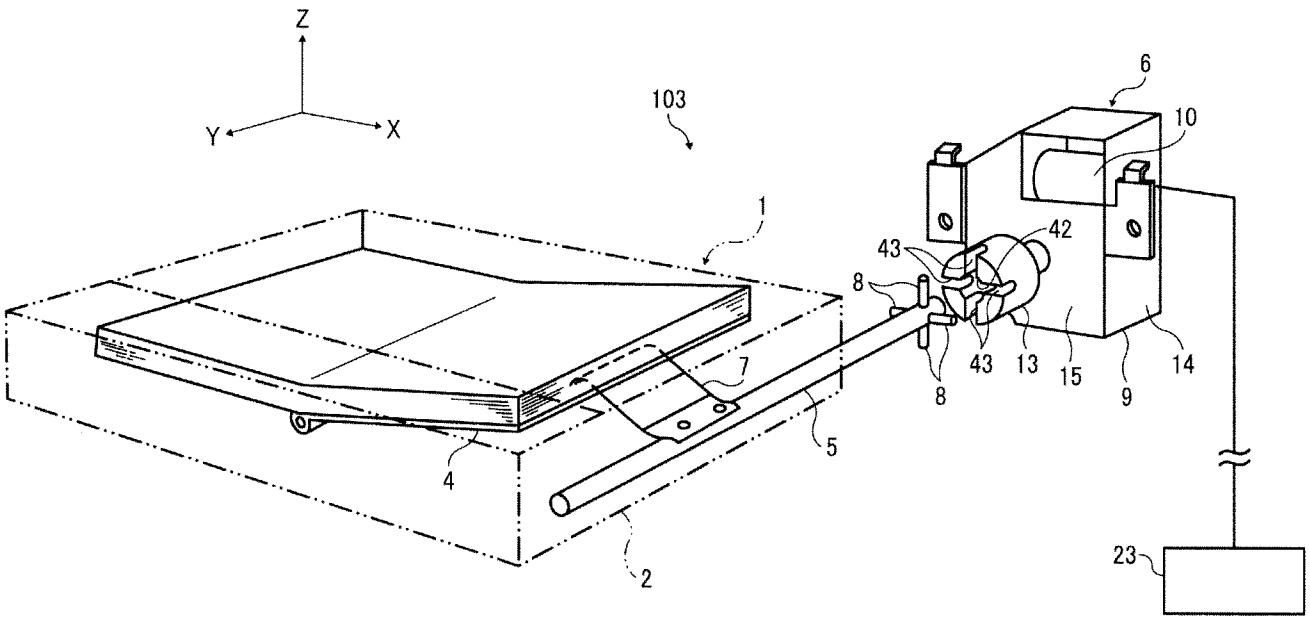
FIG. 2 is a perspective view of the sheet feeding device of the image forming apparatus shown in FIG. 1.
Figure 3:
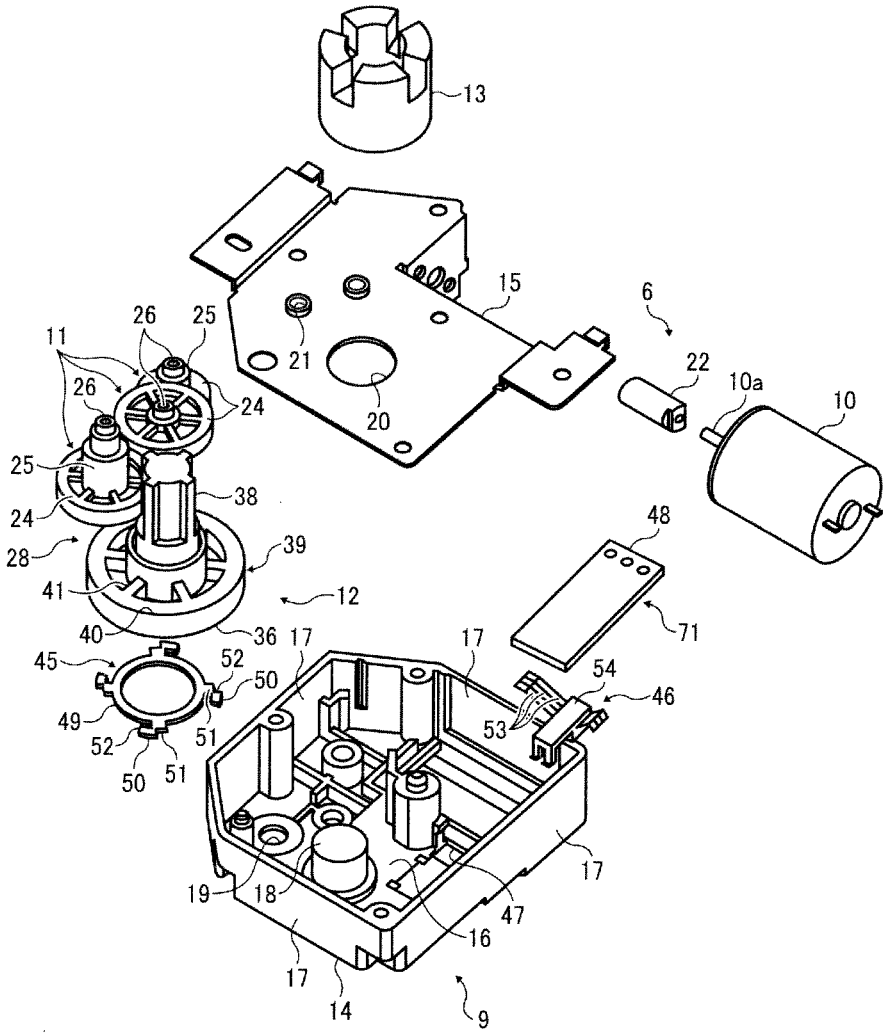
FIG. 3 is a perspective view of a rotation detecting device of the sheet feeding device shown in FIG. 2.

As shown in FIG. 2, the sheet feeding device 1 includes the above-described sheet feeding cassettes 2, a push-up member 4, sheet feeding rollers 3, a drive shaft 5, and a rotation detecting device 6. The sheet feeding cassette 2 is formed in a flat box-like shape with an opening provided on the top thereof. The sheet feeding cassette 2 houses a large volume of recording sheets inside.

The push-up member 4 is formed in a plate-like shape, and its one end is rotatably attached to the center portion of the bottom surface of the sheet feeding cassette 2. The rotation center axis of the push-up member 4 is provided parallel to the moving direction of the sheet feeding cassette 2 being inserted or removed to or from the main body 102. The other end of the push-up member 4 is placed at a position lying on the vertical direction to the sheet feeding roller 3. On the push-up member 4, the recording sheets 107 in the above-described sheet feeding cassette 2 are stacked.

The sheet feeding rollers 3 are rotatably provided in the upper portion of the sheet feeding cassette 2, and are driven to rotate by the motor provided in the main body 102 when the sheet feeding cassette 2 is housed in the main body 102. The longitudinal direction of the sheet feeding roller 3 is provided parallel to the moving direction of the sheet feeding cassette 2 being inserted or removed to or from the main body. The sheet feeding rollers 3 transport the recording sheet 107 in the sheet feeding cassette 2 piece by piece in the gap between the transportation belt 129 and the photoconductive drum 108 as the above-described motor is rotationally driven.

The drive shaft 5 is formed in a cylindrical shape and is rotatably supported by the sheet feeding cassette 2, while being placed near the other end of the push-up member 4. The longitudinal direction of the drive shaft 5 is provided parallel to the moving direction of the sheet feeding cassette 2 being inserted or removed to or from the main body 102. Also, the drive shaft 5 is attached with an interlocking push-up member 7 disposed between the bottom surface of the sheet feeding cassette 2 and the other end of the push-up member 4. The interlocking push-up member 7 is formed in a plate-like shape, and is gradually inclined upward from the drive shaft 5 to the push-up member 4. When the later-described output gear 12 is driven to rotate in the forward rotation direction S (shown by an arrow S in FIG. 4), the interlocking push-up member 7 pushes the push-up member 4 upward. Also, the end of the drive shaft 5 on the inner side of the main body 102 is provided with multiple engaging pins 8 projected from the outer circumferential surface of the drive shaft 5. Four engaging pins 8 are provided in the illustrated example with each pin formed in a cylindrical shape, while being provided in the circumferential direction of the drive shaft 5 at the same intervals.

The rotation detecting device 6 is placed on more inner side of the main body 102 than the sheet feeding cassette 2 housed in the main body 102, and at a position aligned with the drive shaft 5 and the moving direction of the sheet feeding cassette 2, while being fixed to the main body 102. As shown in FIGS.

3, 4, and 5, the rotation detecting device 6 includes a case 9; a motor 10 as a driving source that is housed in the case 9 and causes the later-described output gear 12 to rotate in the forward rotation direction; multiple gears 11 that transmit the rotation driving force of the motor 10 to the output gear 12; the above-described output gear 12 rotatably supported by the case 9; a connecting member 13; and a detecting mechanism 71 that detects rotation of the output gear 12.

The case 9 includes a lower case 14 and an upper cover 15. The lower case 14 includes a bottom plate 16 and a circumferential plate 17 standing upright on the outer edge of the bottom plate 16, and is formed in a flat, tubular shape with a base. The lower case 14 is formed of at least one thermoplastic resin selected from the group consisting of polycarbonate (hereinafter denoted as PC), Acrylonitrile Butadiene Styrene copolymerized synthetic resin (hereinafter denoted as ABS resin), polymethyl methacrylate (hereinafter denoted as PMMA), polyphenylenether (hereinafter denoted as PPE), polystyrene (hereinafter denoted as PS), polyethylene (hereinafter denoted as PE), polypropylene (hereinafter denoted as PP), polybutylene terephthalate (hereinafter denoted as PBT), polyamide (hereinafter denoted as PA), polyacetal (hereinafter denoted as POM), and polyethylene terephthalate (hereinafter denoted as PET). The lower case 14 provided with a cylindrical supporting shaft 18 standing upright on the bottom plate 16 and supports the output gear 12, and a hole 19 in a circular shape which rotatably supports the gears 11.

The upper cover 15 is formed with e.g., sheet metal, and is attached to the lower case 14 so as to cover the opening of the lower case 14. The upper cover 15 is provided with a round hole 20 in a circular shape which rotatably supports the output gear 12, and multiple holes 21 in a circular shape which rotatably support the gears 11.

The motor 10 is mounted on the bottom plate 16 of the lower case 14, while a worm gear 22 is mounted on an output shaft 10*a* of the motor 10. The rotation of the motor 10 is controlled based on commands from a motor controlling device 23 (shown in FIG. 2) which is configured with μCOM.

Similarly to the later-described gear main body 28, multiple gears 11 are each formed of a material whose strength is higher than an electrode holding member 27 (resin containing glass fiber and reinforced by the glass fiber, metal, and sintering material (material formed and hardened by creating bonding between particles of non-metallic or metallic powder)). Three gears 11 are provided in the illustrated example.

The gears 11 integrally include a major-diameter gear 24, a minor-diameter gear 25, and a cylindrical central shaft 26 that are disposed on the same axis. The major-diameter gear 24 and the minor-diameter gear 25 overlap one another, and the central shaft 26 extends away from these gears 24 and 25. The gears 11 are aligned by the insertion of the central shaft 26 through the holes 19, 21, and are rotatably supported by both of the lower case 14 and the upper cover 15, i.e., by the case 9.

Figure 4:
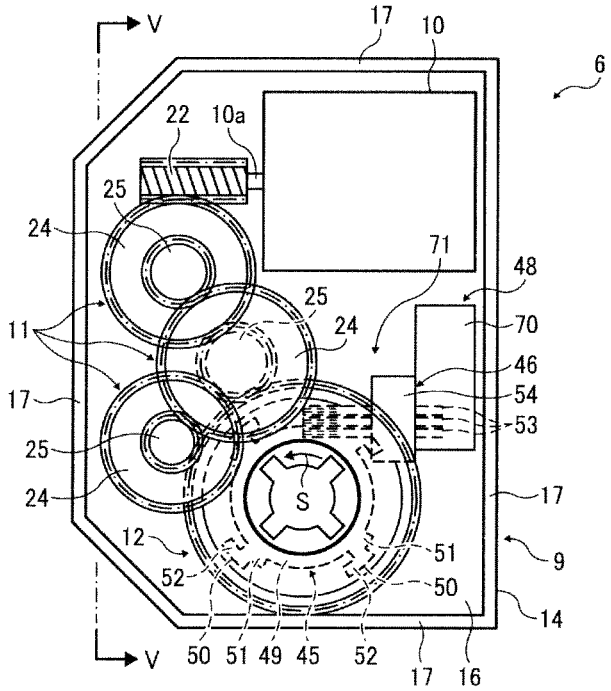
FIG. 4 is a plan view showing the configuration of the rotation detecting device shown in FIG. 3.
Figure 5:
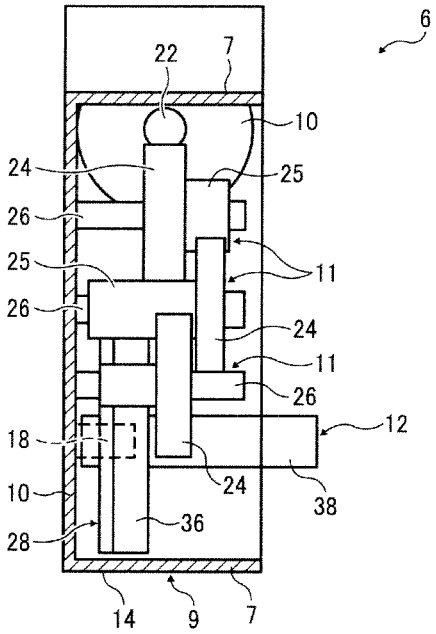
FIG. 5 is a cross-sectional view taken along a V-V line in FIG. 4.
Figure 6:
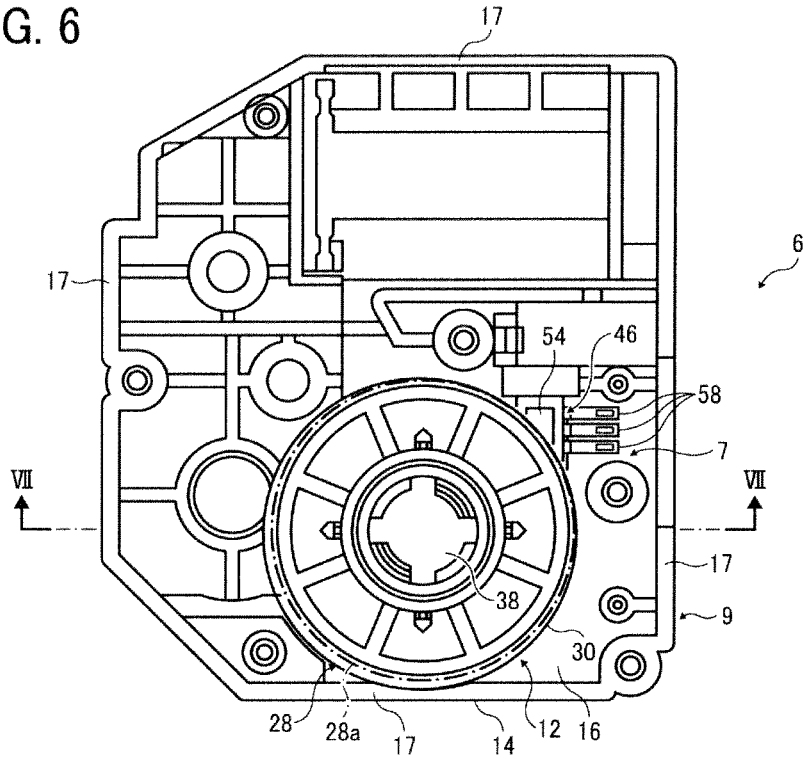
FIG. 6 is a plan view showing a case and an output gear of the rotation detecting device shown in FIG. 3.
Figure 7:
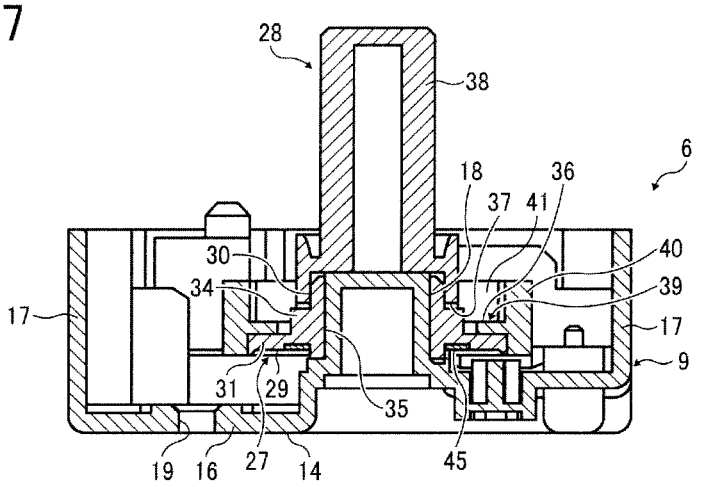
FIG. 7 is a cross-sectional view taken along a VII-VII line in FIG. 6.
Figure 8:
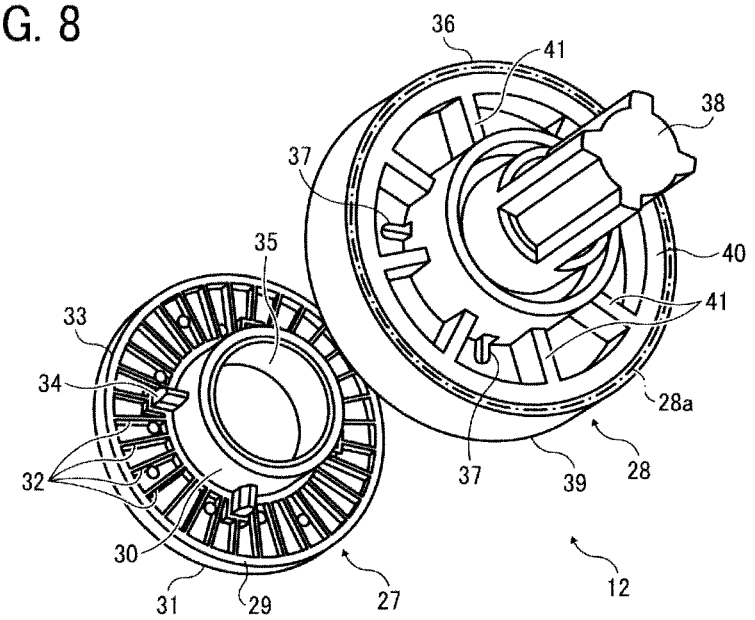
FIG. 8 is an exploded perspective view of the output gear of the rotation detecting device shown in FIG. 3.
Figure 9:
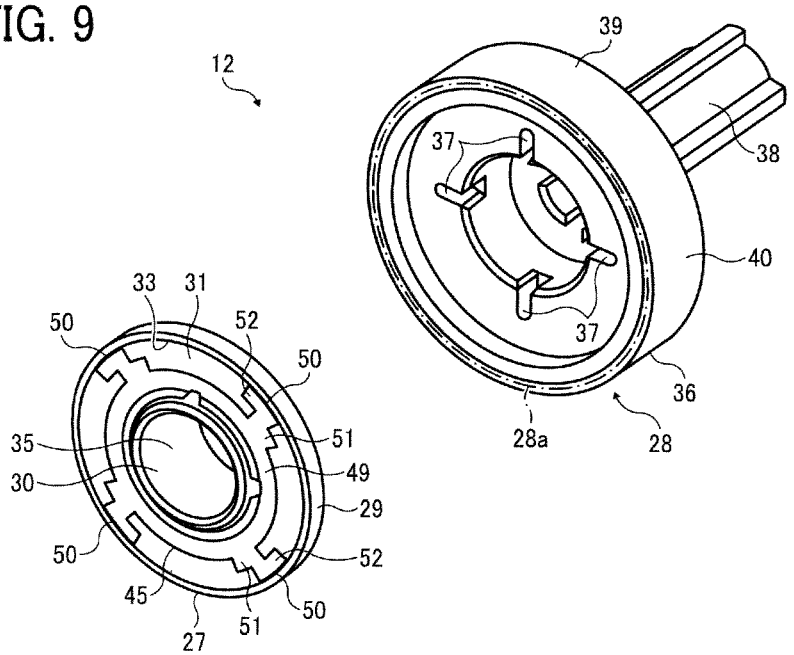
FIG. 9 is another exploded perspective view of the output gear shown in FIG. 8.
Figure 10:
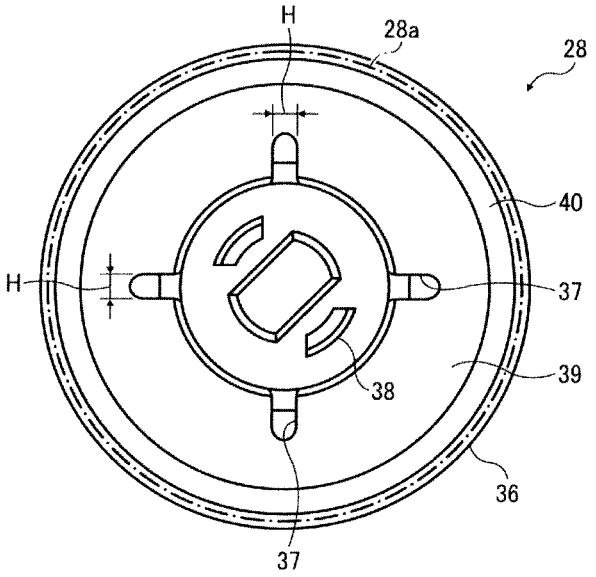
FIG. 10 is a plan view of a gear main body of the output gear shown in FIG. 9.

As shown in FIG. 4, the major-diameter gear 24 of one gear 11 among the multiple gears 11 is engaged with the above-described worm gear 22, the major-diameter gear 24 and the minor-diameter gear 25 adjacent to each other of the gears 11 are engaged with each other, and the minor-diameter gear 25 of another one of the gears 11 is engaged with a gear tooth 28*a* provided on the outer edge of the gear main body 28 of the output gear 12. In this manner, the multiple gears 11 transmit the rotation driving force of the motor 10 to the output gear 12, and rotate the output gear 12 with the driving force of the motor 10, while gradually decreasing the revolutions of the driving force from the above-described motor 10 as well as gradually increasing the torque of the driving force toward the transmission to the output gear 12.

The output gear 12 includes the electrode holding member 27 and the gear main body 28 as shown in FIGS. 6 to 9. The electrode holding member 27 is formed of at least one thermoplastic resin selected from the group consisting of POM, PA, PBT, PP, PE, ABS resin, PS, PPE, PC, and PMMA. Also, the electrode holding member 27 is desirably formed of at least one crystalline resin selected from the group consisting of POM, PA, PBT, PP, and PE out of the above-mentioned thermoplastic resins.

Figure 11:
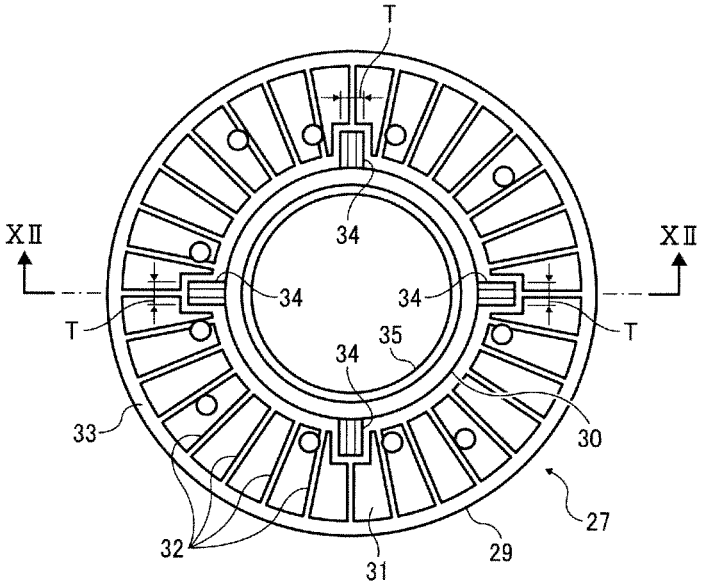
FIG. 11 is a plan view of an electrode holding member of the output gear shown in FIG. 9.
Figure 12:
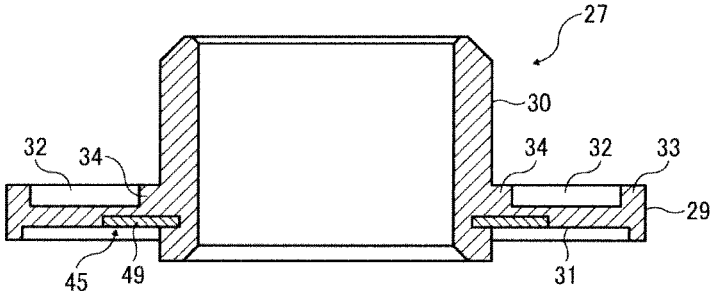
FIG. 12 is a cross-sectional view taken along a XII-XII line in FIG. 11.

As shown in FIGS. 11 and 12, the electrode holding member 27 integrally includes a disk-like disk part 29, and a cylindrical cylinder part 30 standing upright on the center of the disk part 29 with both parts placed on the same axis. The disk part 29 includes a disk-like main body 31, multiple ribs 32 provided on the surface of the main body 31, an outer edge rib 33, and multiple fixing projections 34.

That is to say, the ribs 32 and the outer edge rib 33 are provided in the disk part 29. The main body 31 is provided on its center with a through hole 35 communicating with the inner surface of the cylindrical part 30. The ribs 32 are formed with projections from the surface opposed to the later-described ring part 36 of the gear main body 28 of the main body 31, and linearly extend parallel to the radial direction of the main body 31, i.e., the disk part 29, while being provided at the same intervals in the circumferential direction of the main body 31, i.e., the disk part 29.

The outer edge rib 33 is standing upright on the outer edge of the main body 31 toward the ring part 36 of the gear main body 28, and extends in the circumferential direction of the main body 31, i.e., the disk part 29. In the illustrated example, the outer edge rib 33 is provided on the entire circumference of the main body 31, i.e., the disk part 29.

The fixing projections 34 are projected from the surface of the main body 31 of the disk part 29, and are connected to the outer circumferential surface of the cylindrical part 30. The fixing projections 34 are formed with a uniform thickness T in the radial directions of the disk part 29. The fixing projections 34 are provided spaced apart from each other with the same intervals in the circumferential direction of the disk part 29. Four fixing projections 34 are provided in the illustrated example. In this manner, the rotation detecting device 6 includes the fixing projections 34 which extend from the electrode holding member 27 towards the gear main body 28.

The cylindrical part 30 and the above-described through hole 35 are formed with their inner diameters being approximately equal to the outer diameter of the supporting shaft 18, but slightly greater than the outer diameter of the supporting shaft 18.

The gear main body 28 is formed of a material whose strength is higher than the thermoplastic resin of which the electrode holding member 27 is formed (resin, resin containing glass fiber and reinforced by the glass fiber, metal, or sintering material (material formed and hardened by creating bonding between particles of non-metallic or metallic powder)). The strength referred to in the present specification is so-called bending elastic modulus and tensile elastic modulus. That is to say, the gear main body 28 is formed of the material which cannot be distorted as easily as the electrode holding member 27 even when the gear main body 28 is bent or pulled.

The gear main body 28 is desirably formed of at least one thermoplastic resin selected from the group consisting of POM, PA, and PBT, provided that the above-described conditions are satisfied, and is desirably formed of resin reinforced with glass fiber selected from the group consisting of POM reinforced with glass fiber, PA reinforced with glass fiber, PBT reinforced with glass fiber, and polyphenylene sulfide reinforced with glass fiber (hereinafter denoted as PPS).

The gear main body 28 integrally includes a circular ring part 36 as a fitting receiving part, multiple fixing depressions 37, and a pillar-shaped output shaft 38 standing upright on the inner edge of the ring part 36. The ring part 36 includes a circular main body 39, an outer edge rib 40 standing upright on the outer edge of the main body 39 where the above-described gear tooth 28*a* is formed on the circumferential surface of the outer edge rib 40, and multiple ribs 41 provided on the surface of the ring part 36 apart from the electrode holding member 27 of the ring part 36. That is to say, the ribs 41 and the outer edge rib 40 are provided in the ring part 36. The inner diameter of the main body 39, i.e., the ring part 36 is formed so as to be approximately equal to the outer diameter of the cylindrical part 30 of the electrode holding member 27.

The outer edge rib 40 is placed upright in both directions from the outer edge of the main body 39 to be closer and away from the electrode holding member 27, and extends in the circumferential direction of the main body 39, i.e., the ring part 36. In the illustrated example, the outer edge rib 40 is provided on the entire circumference of the main body 39, i.e., the ring part 36.

The ribs 41 are formed with projections from the above-described surface of the main body 39, and linearly extend parallel to the radial direction of the main body 39, i.e., the ring part 36, while being provided at the same intervals in the circumferential direction of the main body 39, i.e., the ring part 36.

The fixing depressions 37 are formed with depressions from both the surface opposed to the electrode holding member 27 of the main body 39 of the ring part 36 and the inner circumferential surface of the main body 39. In the illustrated example, the fixing depressions 37 penetrate through the main body 39 of the ring part 36. The fixing depressions 37 are formed with a constant width H (shown in FIG. 10) in the radial direction of the ring part 36, while the width H is slightly thinner than the thickness T of the fixing projections 34. The fixing depressions 37 are provided spaced apart from each other with the same intervals in the circumferential direction of the ring part 36. Four fixing depressions 37 are provided in the illustrated example. The fixing projections 34 are inserted and fitted into the fixing depressions 37. The fixing projections 34 and the fixing depressions 37 are fitted into each other to fix the electrode holding member 27 and the gear main body 28 together. In this manner, the rotation detecting device 6 includes the fixing depressions 37 provided in the gear main body 28.

The output shaft 38 are formed in a pillar-shape, placed upright in the direction from the inner edge of the main body 39 of the ring part 36 to be away from the electrode holding member 27.

The above-described output gear 12 is obtained by first aligning the main body 31 of the disk part 29 of the electrode holding member 27 with the main body 39 of the ring part 36 of the gear main body 28 so that the cylindrical part 30 of the electrode holding member 27 is inserted into the ring part 36 of the gear main body 28, and the ring part 36 is fitted into the outer circumference of the cylindrical portion 30, and then by fitting the fixing projections 34 into the fixing depressions 37 so that the electrode holding member 27 and the gear main body 28 are fixed with each other. The output gear 12 is attached to the case 9 rotatably about the supporting shaft 18 in a state where the supporting shaft 18 is inserted into the cylindrical part 30 of the electrode holding member 27. The gear main body 28 is engaged with the above-described gear 11, and the output gear 12 is driven to rotate in the forward rotation direction S (shown by the arrow in FIG. 4) by the driving force of the motor 10.

The connecting member 13 is formed in a short cylindrical shape with the outer diameter greater than that of the output shaft 38, and is attached to a position on the end of the output shaft 38 where the connecting member has the same axis as the output shaft 38. Also, the connecting member 13 is attached to the output shaft 38 slidably in the longitudinal direction of the output shaft 38. In addition, between the connecting member 13 and the upper cover 15, a coiled spring (not shown) is provided to press the connecting member 13 in the direction to be away from the upper cover 15.

An end face 13*a* opposed to the sheet feeding cassette 2 of the connecting member 13 includes a center hole 42 provided in the center of the end face 13*a*, into which one end of the drive shaft 5 is inserted; multiple engaging grooves 43 provided around the center hole 42, which are engaged with engaging pins 8; and a tapered surface 44 which is provided at an edge of the engaging grooves 43, and causes the width of engaging grooves 43 to be decreased gradually as the engaging grooves 43 are moved apart from the drive shaft 5. The connecting member 13 connects the drive shaft 5 and the output gear 12 to each other with one end of the drive shaft 5 inserted into the center hole 42 and the engaging pins 8 inserted into the engaging grooves 43 for engagement. When the connecting member 13 connects the drive shaft 5 and the output gear 12, the tapered surface 44 guides the engaging pins 8 into the engaging grooves 43.

Figure 13:
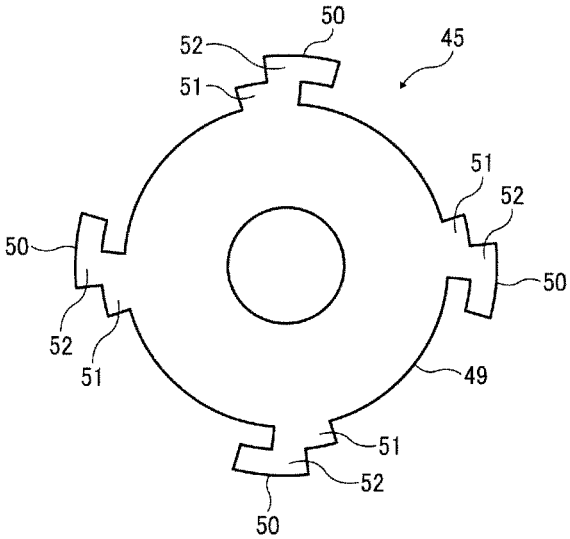
FIG. 13 is a plan view of a rotating electrode attached to the gear main body shown in FIG. 11.

As shown in FIG. 4, the detecting mechanism 71 includes a rotating electrode 45, a fixing member 46, a fix portion 47, and a detection circuit 48. The rotating electrode 45 is obtained by applying e.g., punching processing to a conductive metal sheet. As shown in FIG. 13, the rotating electrode 45 includes a ring part 49 and multiple contact portions 50. The ring part 49 is naturally formed in a ring, while its inner edge is buried in the electrode holding member 27, and its outer edge is exposed on the surface away from the gear main body 28 of the main body 31 of the disk part 29 of the electrode holding member 27. The ring part 49, i.e., the rotating electrode 45 is naturally placed on the same axis as the electrode holding member 27. The contact portions 50 are connected to the outer edge of the ring part 49, and are provided in the circumferential direction of the ring part 49 at the same intervals. Four contact portions 50 are provided in the illustrated example. Accordingly, the contact portions 50 are provided every 90 degrees on the ring part 49 and the electrode holding member 27, i.e., the output gear 12. The contact portions 50 each includes a first contacted portion 51 which is connected to the outer edge of the ring part 49, and a second contacted portion 52 which is further connected to the first contacted portion 51. The first contacted portion 51 and the second contacted portion 52 are both formed so as to be curved along the outer edge of the ring part 49, and to have the same length in the circumferential direction of the ring part 49. The second contacted portion 52 is disposed at a rear position from the first contacted portion 51 in the forward rotation direction S of the output gear 12.

The fixing member 46 includes multiple fixed electrodes 53 and an electrode fixing member 54. The fixed electrode 53 is obtained by applying punching processing or bending processing to a conductive metal sheet. When the fixing member 46 is mounted on the case 9, the fixed electrode 53 has its planar shape linearly formed in a strip shape, while being formed so as to be bent at multiple locations as viewed from the side. The fixed electrodes 53 are placed spaced apart from each other and in parallel to each other. In the illustrated example, three fixed electrodes 53 are provided and, moreover, the three fixed electrodes 53 are arranged in the radial direction of the output gear 12.

The fixed electrode 53 includes a supported part 55 provided in the center, an electrode contact portion 56 connected to one end of the supported part 55, and an electrical connection portion 57 connected to the other end of the supported part 55. The electrode contact portion 56 is formed so as to be gradually inclined in the direction from the supported part 55 to the output gear 12. The end of the electrode contact portion 56 is provided with a contact portion 58 which is curved in the direction to be away from the output gear 12, and curved to be projected toward the output gear 12.

When the fixing members 46 of these three fixed electrodes 53 are attached to the case 9, the fixed electrodes 53 are provided between the output gear 12 and the bottom plate 16 of the case 9. The fixed electrode 53 closest to the output shaft 38 of the output gear 12 among these three fixed electrodes 53 comes into contact with the ring part 49 of the rotating electrode 45 at its contact portion 58, and is constantly electrically connected to the ring part 49. The fixed electrode 53 located in the middle among the three fixed electrodes 53 comes into contact with the first contacted portion 51 of the rotating electrode 45 at its contact portion 58, and is provided at a location to be electrically connected to the first contacted portion 51. Further, the fixed electrode 53 farthest from the output shaft 38 of the output gear 12 among the three fixed electrodes 53 comes into contact with the second contacted portion 52 of the rotating electrode 45 at its contact portion 58, and is provided at a location to be electrically connected to the second contacted portion 52. The electrical connection portion 57 is electrically connected to the detection circuit 48.

The electrode fixing member 54 is formed of insulating synthetic resin, and covers the supported parts 55 of the three fixed electrodes 53, and is integrally formed with the three fixed electrodes 53. In the illustrated example, the electrode fixing member 54 is integrally formed with the three fixed electrodes 53 by insertion molding.

Figure 17:
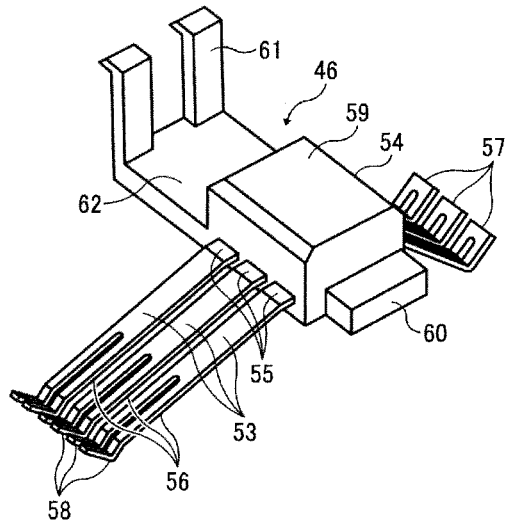
FIG. 17 is a perspective view of the fixing member shown in FIG. 14.

As shown in FIG. 17, the electrode fixing member 54 integrally includes a cover part 59 for covering the supported parts 55 of the three fixed electrodes 53, a stopper projection 60 projected from one end of the cover part 59, and a latch arm 61 connected to the other end of the cover part 59.

The stopper projection 60 is formed to be projected from one end of the cover part 59 in the direction perpendicular to the longitudinal direction of the fixed electrode 53. The latch arm 61 is connected to an extending part 62 that extends from the other end of the cover part 59 in the direction perpendicular to the longitudinal direction of the fixed electrode 53, and stands upright in the direction from the extending part 62 to the bottom plate 16 of the case 9.

Figure 18:
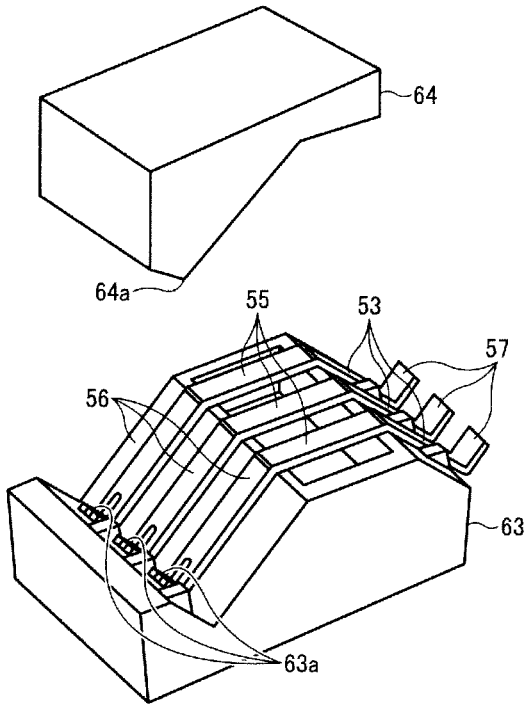
Figure 19:
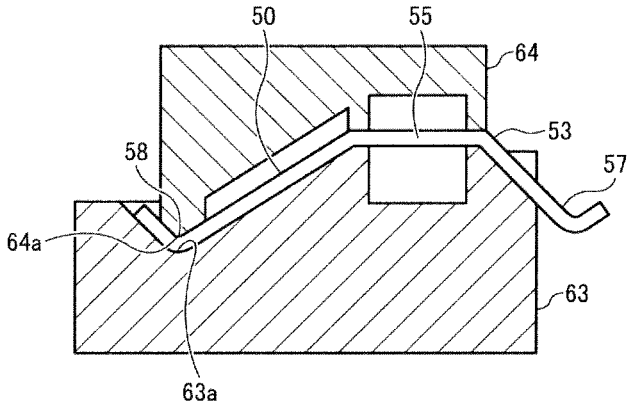

As shown in FIGS. 18 and 19, the above-described fixing member 46 is obtained by inserting synthetic resin between a pair of molds 63 and 64 along with the fixed electrodes 53 and injection-molding the synthetic resin in the cavity of the molds 63 and 64. The cavity between the molds 63 and 64 is formed to be approximately the same outer shape as the fixed member 46. These molds 63 and 64 are provided with positioning parts 63*a* and 64*a* which form a part of the cavity, and position the fixed electrode 53 with the contact portion 58 of fixed electrode 53 inserted into the cavity.

Figure 14:
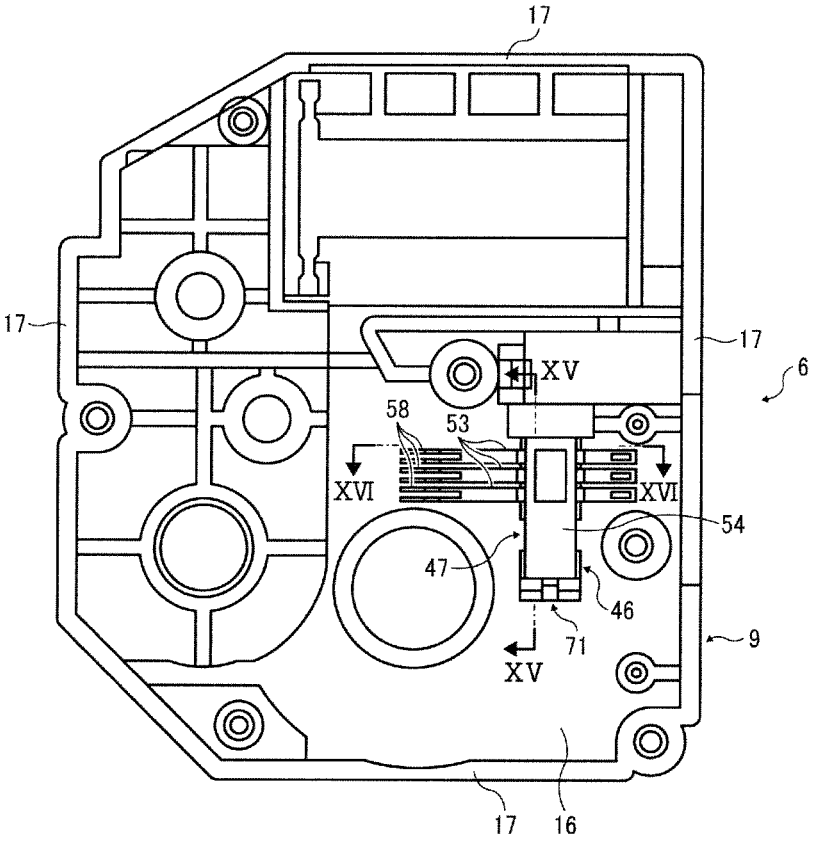
FIG. 14 is a plan view showing a case and a fixing member for the rotation detecting device shown in FIG. 3.
Figure 15:
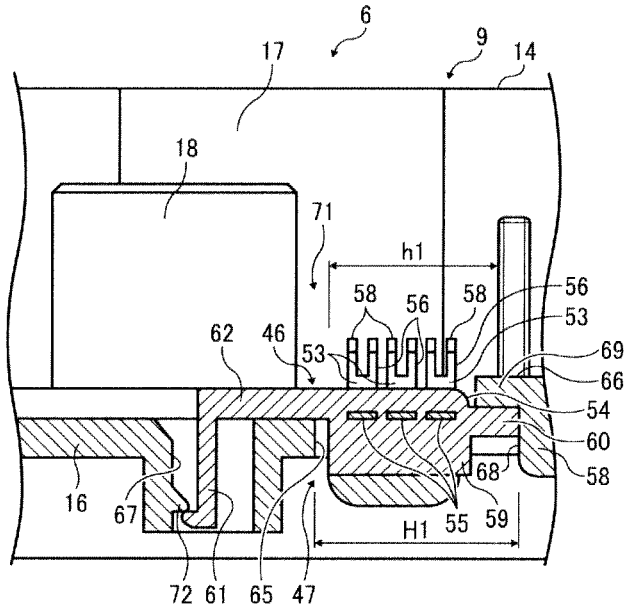
FIG. 15 is a cross-sectional view taken along a XV-XV line in FIG. 14.
Figure 16:
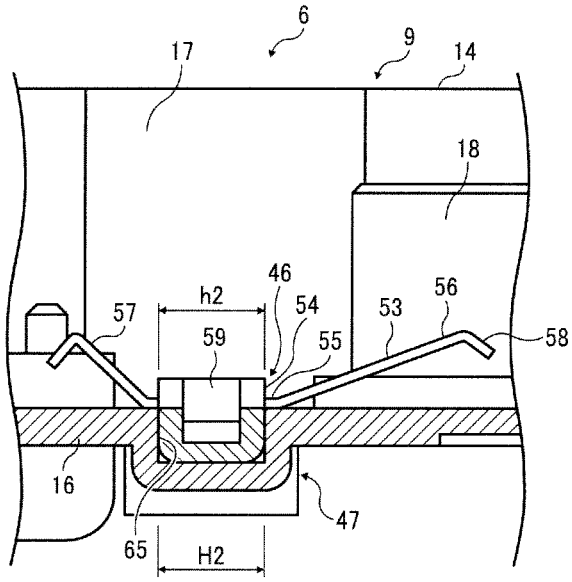
FIG. 16 is a cross-sectional view taken along a XVI-XVI line in FIG. 14.

As shown in FIGS. 14 to 16, the fix portion 47 includes a receiving hole 65 penetrating through the bottom plate 16 of the case 9, a stopper part 66, and a latch cylinder 67 provided near the receiving hole 65. The receiving hole 65 is generally provided between the supporting shaft 18 and the motor 10, and the electrode fixing member 54 is inserted inside the receiving hole 65. The width H1 (shown in FIG. 15) in the radial direction of the output gear 12 of the receiving hole 65 is formed to be greater than the width h1 in the radial direction of the output gear 12 of the combined portion of the cover part 59 of the electrode fixing member 54 and the stopper part 66. Also, the width H2 (shown in FIG. 16) in the circumferential direction of the output gear 12 of the receiving hole 65 is formed to be slightly smaller than, i.e., approximately equal to the width h2 in the circumferential direction of the output gear 12 of the cover part 59 of the electrode fixing member 54. The widths H1, h1 in the radial direction mean the width of the receiving hole 65 that positions or allow the movement of the contact portion 58 of the fixed electrode 53 in the radial direction of the output gear 12. The widths H2, h2 in the circumferential direction mean the width of the receiving hole 65 that positions or allows the movement of the contact portion 58 of the fixed electrode 53 in the circumferential direction of the output gear 12.

As shown in FIG. 15, the stopper part 66 includes an upright wall 68 that is standing upright on the inner edge portion closer to the motor 10 along the inner edge of the receiving hole 65, and a parallel wall 69 that extends from the end of the upright wall 68 toward the output gear 12 parallel to the bottom plate 16.

As shown in FIG. 15, the latch cylinder 67 is standing upright on the bottom plate 16 of the case 9 in the reverse direction of the supporting shaft 18, and the inside of the latch cylinder 67 is a hole penetrating through the bottom plate 16. The inner surface of the cylinder for latch 67, which is away from the receiving hole 65, is provided with a latch projection 72 that is latched into the end of the latch arm 61.

The fix portion 47 houses the electrode fixing member 54 in the receiving hole 65, and the stopper projection 60 is inserted between the bottom plate 16 and the parallel wall 69 and then abuts against the upright wall 68, while the end of the latch arm 61 is latched into the latch projection 72 in the latch cylinder 67 so that the electrode fixing member 54 is fitted and fixed. At this point, the stopper projection 60 abuts against the upright wall 68 due to the elastic restoring force of the latch arm 61, and the widths H1, H2, h1, h2 are formed in the above-described dimensions, and thus the electrode fixing member 54, i.e., the fixing member 46 is fixed to the case 9.

As shown in FIG. 4, the detection circuit 48 includes a printed wire board 70 placed near the lateral side of the output gear 12, and multiple circuit components mounted on the printed wire board 70. The three fixed electrodes 53 are electrically connected to each other in a pre-defined pattern by the detection circuit 48. The detection circuit 48 detects a rotation angle of the output gear 12, i.e., rotation of the output gear 12 by detecting whether the contact portion 58 of the fixed electrode 53 has come into contact with the contacted portions 51, 52 of the rotating electrode 45 or not.

When the sheet feeding cassette 2 is housed in the main body 102 of the image forming apparatus 101, in the above-described rotation detecting device 6, the engaging pin 8 is engaged in the engaging groove 43 of the connecting member 13 so that the connecting member 13 connects the drive shaft 5 and the output gear 12. That is to say, the output gear 12 is connected to the drive shaft 5. The rotation detecting device 6 then makes the motor controlling device 23 rotate the output gear 12 and the drive shaft 5 in the forward rotation direction S by the motor 10, so that the interlocking push-up member 7 attached to the drive shaft 5 pushes the push-up member 4 upward against the sheet feeding roller 3.

When the recording sheet 107 on the push-up member 4 comes into contact with the sheet feeding roller 3, the rotation detecting device 6 is configured to stop the rotation of the output gear 12 and the drive shaft 5. In this manner, the rotation detecting device 6 rotates the output gear 12 and the drive shaft 5 until the recording sheet 107 on the push-up member 4 comes into contact with the sheet feeding roller 3, then calculates the number of recording sheets 107 in the sheet feeding cassette 2 by detecting the rotation angle of the output gear 12 at this moment with the detection circuit 48 of the detecting mechanism 71. The image forming apparatus 101 displays the number of recording sheets 107 in the sheet feeding cassette 2 detected by the rotation detecting device 6 on e.g., a displaying unit provided on the upper portion of the main body 102.

The image forming apparatus 101 in the above-described configuration forms an image on the recording sheet 107 as shown below. First, the image forming apparatus 101 rotates the photoconductive drum 108, and uniformly charges the outer surface of the photoconductive drum 108 at −700V by the charging roller 109. The photoconductive drum 108 is exposed by emitting a laser beam to the outer surface of the photoconductive drum 108 so that the voltage at the image portion is attenuated to −150V to form an electrostatic latent image on the outer surface of the photoconductive drum 108. When the electrostatic latent image is opposed to the developing roller 126, a developing bias voltage of −550V is applied to the electrostatic latent image, so that the toner as the developer sticking to the outer surface of the developing roller 126 of the developing unit 113 is transferred onto the outer surface of the photoconductive drum 108. Thus, an electrostatic latent image is developed, and a toner image is formed on the outer surface of the photoconductive drum 108.

In the image forming apparatus 101, the recording sheet 107 transported by the sheet feeding roller 3 of the sheet feeding unit 103 is positioned between the photoconductive drums 108 of the process cartridges 106Y, 106M, 106C, 106K and the transportation belt 129 of the transfer unit 104, and then the toner image formed on the outer surface of the photoconductive drum 108 is transferred to the recording sheet 107. The image forming apparatus 101 fixes the toner image on the recording sheet 107 with the fixing unit 105. In this manner, the image forming apparatus 101 forms a color image on the recording sheet 107.

On the other hand, the remaining toner on the photoconductive drum 108, which was not transferred, is collected. The photoconductive drum 108 whose remaining toner has been removed is initialized by a destaticizing lamp which is not shown, and is used for the next image formation processing.

Also, in the above-described image forming apparatus 101, process control is performed in order to suppress the variation in image quality due to an environmental change or a change over time. Specifically, the developing performance of the developing unit 113 is detected first. For example, an image with a certain toner pattern is formed on the photoconductive drum 108 in the condition where developing bias voltage is constant, and its image density is detected by a photosensor which is not shown, and then the developing performance is evaluated from a variation in the density. The image quality can be maintained at a constant level by changing a target value of the toner density so as to make the developing performance equivalent to a predetermined target developing performance. For example, in the case where the image density of the toner pattern detected by the photosensor is lower than the target developing density, the CPU as a control means (not shown) controls the developing unit 113 so as to increase the toner density. On the other hand, in the case where the image density of the toner pattern detected by the photosensor is higher than the target developing density, the CPU controls the above-described drive circuit of the motor so as to decrease the toner density. The above-mentioned toner density is detected by the toner density sensor which is not shown. The image density of the toner pattern formed on the photoconductive drum 108 may be varied more or less due to the influence of an image density cycle variation of the developing roller 126.

According to the present embodiment, the output gear 12 is configured with the electrode holding member 27 rotatably supported by the case 9, and the gear main body 28 provided with the gear tooth 28*a* on its outer edge. The electrode holding member 27 is formed of a thermoplastic resin, and the gear main body 28 is formed of a material whose strength is higher than the thermoplastic resin. Thus, the electrode holding member 27 rotatably supported by the case 9 is not easily worn out and the gear main body 28 engaged with other gears 11 is also not easily worn out. Accordingly, abrasion wear of the electrode holding member 27 due to aged deterioration can be reduced, and an increase in misalignment of the electrode holding member 27, i.e., the case 9 of the output gear 12 due to aged deterioration can be prevented. Thus, a rotation angle of the output gear 12 can be accurately detected for a long period of time, while the number of the recording sheets 107 can be accurately detected.

The multiple ribs 32 extending in the radial direction of the disk part 29 of the electrode holding member 27 are provided spaced apart in the circumferential direction. Thus, distortion of the electrode holding member 27 caused as it is molded and hardened by injection molding can be suppressed. Therefore, a rotation angle of the output gear 12 can be accurately detected surely for a long period of time.

Furthermore, the gear main body 28 is provided with the ring part 36 that fits into the outer circumference of the cylindrical part 30 of the electrode holding member 27. Thus, misalignment between the gear main body 28 and the electrode holding member 27 can be prevented. Therefore, a rotation angle of the output gear 12 can be accurately detected more surely for a long period of time.

Because the outer edge rib 33 standing upright on the outer edge of the disk part 29 of the electrode holding member 27 is provided, distortion of the electrode holding member 27 caused as it is molded and hardened by injection molding can be suppressed more surely. Therefore, a rotation angle of the output gear 12 can be accurately detected more surely for a long period of time.

Because the electrode holding member 27 is provided with the fixing projections 34, and the gear main body 28 is provided with the fixing depressions 37 into which the fixing projections 34 are fitted, misalignment between the electrode holding member 27 and the gear main body 28 can be further prevented. Therefore, a rotation angle of the output gear 12 can be accurately detected more surely for a long period of time.

Because the electrode fixing member 54 is integrally formed with the fixed electrode 53, and the case 9 is provided with the fix portion 47 into which the electrode fixing member 54 is fitted and fixed, misalignment between the fixed electrode 53 and the electrode fixing members 54, and between the electrode fixing member 54 and the case 9 can be prevented. Therefore, a rotation angle of the output gear 12 can be accurately detected more surely for a long period of time.

Because the above-described sheet feeding device 1 is provided with the rotation detecting device 6, a rotation angle of the output gear 12 can be accurately detected for a long period of time and the number of the recording sheets 107 can be accurately detected for a long period of time.

Furthermore, the image forming device 101 is provided with the above-described sheet feeding device 1, a rotation angle of the output gear 12 can be accurately detected for a long period of time and the number of the recording sheets 107 can be accurately detected for a long period of time.

Figure 20:
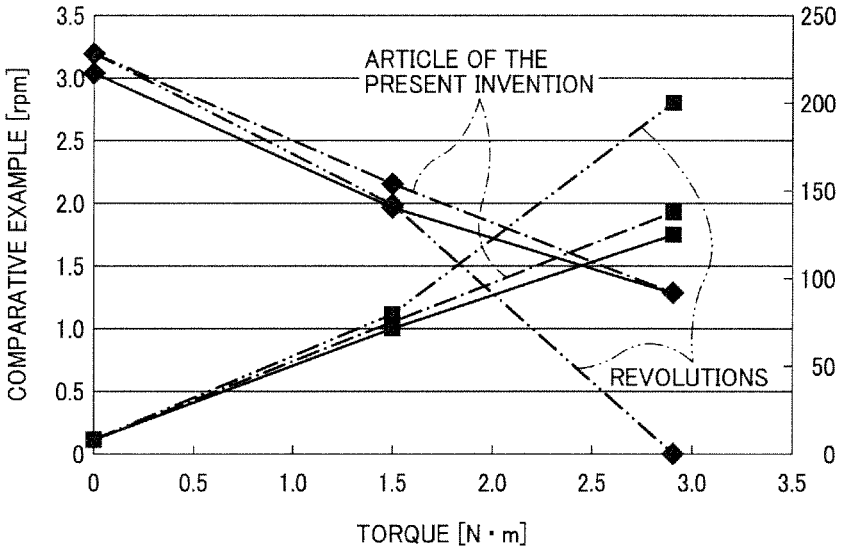
FIG. 20 is an explanatory diagram showing a torque of the output gear after durability tests of articles of the present invention and comparative examples.

Next, the inventors of the present invention have confirmed the effects of the above-described embodiment. The results are shown in FIG. 20. In the experiment shown in FIG. 20, for the article of the present invention (shown by a dashed dotted line in FIG. 20) of the above-described embodiment, and the conventional comparative example (shown by a double-dashed dotted line in FIG. 20), the relationship (shown by a square in FIG. 20) between the torque of the output gear 12 and the value of current applied to the motor 10 after a durability test and the relationship (shown by a rhombus in FIG. 20) between the torque of the output gear 12 and the revolutions of the output gear 12 after the durability test were measured. As the comparative example, an article is used where the output gear 12 is integrally formed with POM reinforced with glass fiber, and as the article of the present invention, an article is used where the output gear 12 is composed of the electrode holding member 27 formed by POM, and the gear main body 28 formed by POM reinforced with glass fiber. For both of the article of the present invention and the conventional comparative example, the relationship between (shown by a solid line in FIG. 20) the torque of the output gear 12 and the value of current applied to the motor 10, and the relationship (shown by a solid line in FIG. 20) between the torque of the output gear 12 and the revolutions of the output gear 12 are equal to each other before the durability test. Also, for both of the articles of the present invention and the conventional comparative example, the supporting shaft 18, i.e., the lower case 14 include PC and ABS resin.

According to FIG. 20, in the comparative example for which the output gear 12 integrally formed with POM reinforced with glass fiber is used, the torque which restricts the output gear of the supporting shaft 18 may become zero after the durability test, in other words, even when the motor 10 is driven to rotate, the output gear 12 may not rotate because the output gear 12 slides on the supporting shaft. On the other hand, in the article of the present invention, the torque which restricts the output gear of the supporting shaft 18 never becomes zero after the durability test. As described above, it has been found that in the article of the present invention, the output gear 12 is not easily worn out on the portion in contact with the supporting shaft 18 as in the case with the comparative example.

Next, in the article of the present invention and the comparative example, the inventors of the present invention measured the abrasion wear of the supporting shaft 18 of the case 9 and the fixed electrode 53 as well as the conditions in which the abrasion wear causes an error in calculating the recording sheets 107. The results are shown in the following table 1.

TABLE 1

| | ARTICLE OF PRESENT INVENTION | | | COMPARATIVE EXAMPLE | | | COMPARATIVE EXAMPLE - ARTICLE OF PRESENT INVENTION | |
|---|---|---|---|---|---|---|---|---|
| | ABRASION WEAR (2x) | ANGLE CONVERSION (θ) | SHEET CONVERSION | ABRASION WEAR (2x) | ANGLE CONVERSION (θ) | SHEET CONVERSION | ANGLE CONVERSION (θ) | SHEET CONVERSION |
| (A) WEAR OF CASE (SHAFT) | 0.005 mm | 0.0° | 0 sheet | 0.12 mm | 0.3° | 4 sheets | 0.3° | 4 sheets |
| (B) WEAR OF FIXED E-LECTRODE | 0.38 mm | 0.9° | 12 sheets | 0.76 mm | 0.9° | 25 sheets | 0.9° | 13 sheets |
| (A) + (B) | 0.39 mm | 1.0° | 12 sheets | 0.88 mm | 2.2° | 28 sheets | 1.2° | 16 sheets |
| | MOUNTING MIS-ALIGNMENT (x) | ANGLE CONVERSION (θ) | SHEET CONVERSION | MOUNTING MIS-ALIGNMENT (x) | ANGLE CONVERSION (θ) | SHEET CONVERSION | ANGLE CONVERSION (θ) | SHEET CONVERSION |
| (C) FIXING OF FIXED ELECTRODE AND CASE | 0.10 mm | 0.5° | 6 sheets | 0.25 mm | 1.2° | 16 sheets | 0.7° | 10 sheets |
| (A) + (B) + (C) | 0.49 mm | 1.5° | 19 sheets | 0.13 mm | 3.4° | 45 sheets | 2.0° | 26 sheets |

For the article of the present invention, wear after the durability test was measured by using the output gear 12 for which the electrode fixing member 54 is formed of POM. For the comparative example, wear after the durability test was measured by using the output gear 12 which is formed of POM reinforced with glass fiber. The supporting shaft 18 of the present invention article and the comparative example includes PC and ABS resin.

The abrasion wear of the supporting shaft 18 indicates the wear amount of the outer diameter of the supporting shaft 18.

Figure 24:
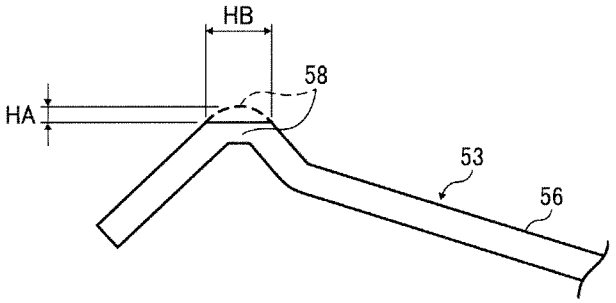
FIG. 24 is a side view illustrating the wearing state of the fixed electrodes of an article of the present invention and a comparative example.

The abrasion wear of the fixed electrode 53 indicates the width HB of the portion of the contact portion 58 of the fixed electrode 53 that has been worn out and has become flat after the durability test shown in FIG. 24. Assuming that the distance between the center of the width direction of the first contacted portion 51, and the center of the rotating electrode is 11.5 mm when the contact point between the first contacted portion 51 of the rotating electrode 45 and the contact portion 58 of the fixed electrode 53 is shifted by X mm, the conversion angle θ of abrasion wear is expressed by the following equation 1:

$$\theta(\text{degree})=X\div(\pi\times 23)\times 360 \qquad \text{Equation 1}$$

Next, assuming that the thickness of the recording sheet 107 is 0.09 mm, the number of the recording sheets 107 per 1 degree of rotation angle of the drive shaft 5 is 13 sheets. Thus, converted number of sheets for abrasion wear is expressed by the following equation 2.

$$\text{Converted number of the recording sheets } 107=\theta\times 13 \qquad \text{Equation 2}$$

According to the result of Table 1, the article of the present invention has less abrasion wear of the supporting shaft 18 and the fixed electrode 53 than the comparative example, and it has been made clear that an error in measuring the number of the recording sheet 107 for the article of the present invention is less as much as 26 sheets than that of the comparative example.

Also, the inventors of the present invention measured an increase in misalignment between the supporting shaft 18 and the output gear 12 caused by the durability test in the above-described article of the present invention and the comparative example. The result is shown in the following table 2.

TABLE 2

| | MATERIAL | BEFORE DURABILITY TEST | | AFTER DURABILITY TEST | | INCREASE IN MISALIGNMENT |
|---|---|---|---|---|---|---|
| | | SUPPORTING SHAFT OUTER DIAMETER | OUTPUT GEAR INNER DIAMETER | SUPPORTING SHAFT OUTER DIAMETER | OUTPUT GEAR INNER DIAMETER | |
| ARTICLE OF PRESENT INVENTION | POM | 12.47 | 12.51 | 12.47 | 12.52 | 0.01 |
| COMPARATIVE EXAMPLE | glass POM | 12.47 | 12.51 | 12.37 | 12.53 | 0.12 |

According to Table 2, the increase in misalignment of the article of the present invention is less than 1/10 of the increase in misalignment of the comparative example. Thus, it has been made clear that the article of the present invention can suppress the occurrence of misalignment.

Also, the inventors of the present invention measured abrasion wear of the fixed electrode 53 caused by the durability test in the above-described comparative example compared with the article of the present invention. The result is shown in the following table 3. The wear width indicates the width HB of the portion of the contact portion 58 of the fixed electrode 53 that has worn out and become flat after the durability test shown in FIG. 24. The wear height indicates the distance HA between the contact portion 58 (shown by a dotted line) before the durability test shown in FIG. 24, and the portion of the contact portion 58 of the fixed electrode 53 that has worn out and become flat after the durability test.

TABLE 3

| BEARING MATERIAL | WEAR HEIGHT | WEAR WIDTH |
|---|---|---|
| COMPARATIVE EXAMPLE | 0.162 | 0.760 |
| ARTICLE OF PRESENT INVENTION | 0.034 | 0.380 |

According to Table 3, it has been made clear that the fixed electrode 53 of the article of the present invention is not easily worn out as the fixed electrode of the comparative example, thus it has been determined that the article of the present invention can suppress wear. According to the above-described rotation detecting device, the output gear is composed of the electrode holding member rotatably supported by the case, and the gear main body provided with the gear tooth on its outer edge, and the electrode holding member is formed of a thermoplastic resin, and the gear main body is formed of material whose strength is higher than the thermoplastic resin. Thus, the electrode holding member rotatably supported by the case is not easily worn out and the gear main body engaged with other gears is also not easily worn out. Accordingly, abrasion wear of the electrode holding member due to aged deterioration can be reduced, and an increase in misalignment of the electrode holding member, i.e., the case of the output gear due to aged deterioration can be prevented. Thus, a rotation angle of the output gear can be accurately detected for a long period of time.

The multiple ribs extending in the radial direction of the disk part of the electrode holding member are provided spaced apart in the circumferential direction. Thus, distortion of the electrode holding member caused as it is molded and hardened by injection molding can be suppressed. Therefore, a rotation angle of the output gear can be accurately detected surely for a long period of time.

Because the gear main body is provided with the fitting receiving part that fits into the outer circumference of the cylindrical part of the electrode holding member, misalignment between the gear main body and the electrode holding member can be prevented. Therefore, a rotation angle of the output gear can be accurately detected more surely for a long period of time.

Because the outer edge rib standing upright on the outer edge of the disk part of the electrode holding member is provided, distortion of the electrode holding member caused as it is molded and hardened by injection molding can be suppressed more securely. Therefore, a rotation angle of the output gear can be accurately detected more surely for a long period of time.

Because one of the electrode holding member and the gear main body is provided with the fixing projections, and the other one is provided with the fixing depressions into which the fixing projections are fitted, misalignment between the electrode holding member and the gear main body can be further prevented. Therefore, a rotation angle of the output gear can be accurately detected more surely for a long period of time.

Because the electrode fixing member is integrally formed with the fixed electrode, and the case is provided with the fix portion into which the electrode fixing member is fitted and fixed, misalignments between the fixed electrode and the electrode fixing members, and between the electrode fixing member and the case can be prevented. Therefore, a rotation angle of the output gear can be accurately detected more surely for a long period of time.

Because the above-described rotation detecting device is provided, a rotation angle of the output gear can be accurately detected for a long period of time and the number of the recording sheets can be accurately detected for a long period of time.

Because the above-described sheet feeding device is provided, a rotation angle of the output gear can be accurately detected for a long period of time and the number of the recording sheets can be accurately detected for a long period of time.

In the above-described embodiment, the electrode holding member 27 is provided with the fixing projections 34, and the gear main body 28 is provided with the fixing depressions 37. Instead, in the present invention, the electrode holding member 27 may be provided with the fixing depressions 37, and the gear main body 28 may be provided with the fixing projections 34.

Figure 21:
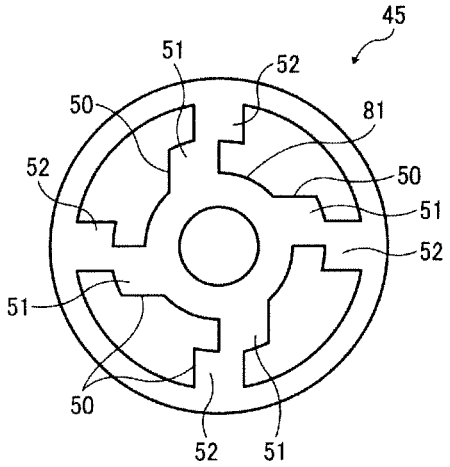
FIG. 21 is a plan view of a modified example of the rotating electrode shown in FIG. 13.

Also, the rotating electrode 45 may be configured as shown in FIG. 21. In FIG. 21, the same components as in the above-described embodiment are labeled with the same reference symbols, and description thereof is omitted. In the case shown in FIG. 21, the rotating electrode 45 includes an inner ring part 81 buried in the electrode holding member 27; and an outer ring part 82 exposed to the surface of the electrode holding member 27, to be in contact with the fixed electrode 53.

Figure 22:
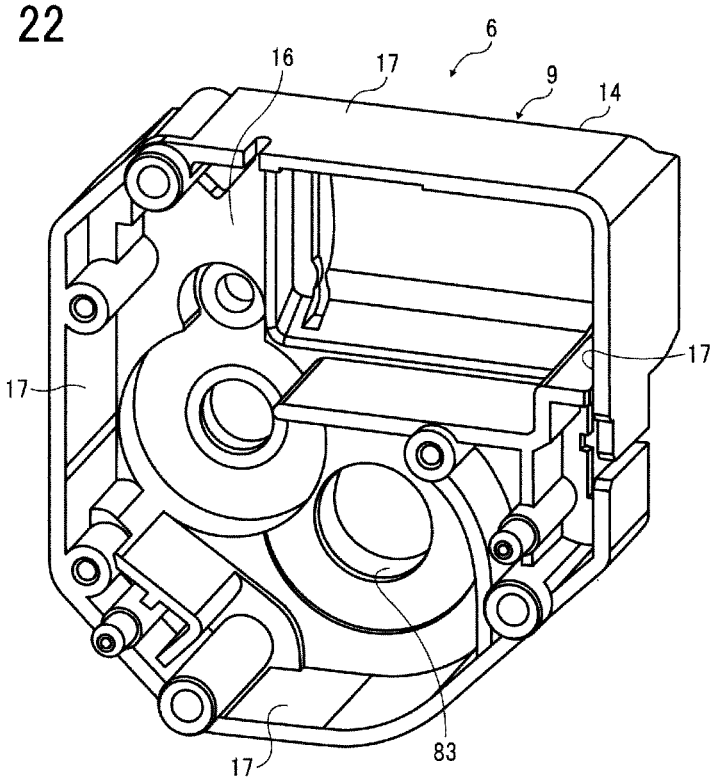
FIG. 22 is a perspective view of a modified example of the case shown in FIG. 3.
Figure 23:
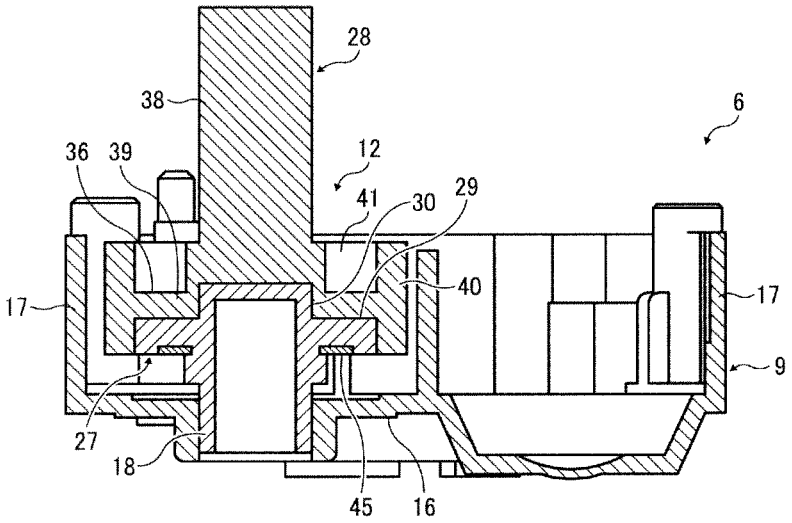
FIG. 23 is a cross-sectional view showing the case and the output gear shown in FIG. 22.

Furthermore, in the present invention, as shown in FIGS. 22 and 23, the electrode holding member 27 of the output gear 12 may be provided with the supporting shaft 18, and the bottom plate 16 of the case 9 may be provided with a supporting through hole 83 inside which the supporting shaft 18 is rotatably supported. In FIGS. 22 and 23, the same components as in the above-described embodiment are labeled with the same reference symbols, and description thereof is omitted.

The present invention is not limited to the embodiment described above. That is to say, various modifications can be made without departing from the scope of the present invention. More specifically, in the present invention, even in the case where the electrode holding member 27 is formed of the above-described thermoplastic resin or desirably other crystalline resin different from POM, similar effects to those in the above-described article of the present invention can be obtained. Even when the gear main body 28 is formed of a material whose strength is higher than the thermoplastic resin of which the electrode holding member 27 is formed, or resin reinforced by glass fiber, metal, or sintering material (material formed and hardened by creating bonding between particles of non-metallic or metallic powder) other than POM reinforced with glass fiber, similar effects to those in the above-described article of the present invention can be obtained. That is to say, even when the gear main body 28 is formed of the above-described resin or a resin reinforced by glass fiber, similar effects to those in the above-described article of the present invention can be obtained. Also, note that in the present invention, even when the supporting shaft 18, i.e., the lower case 14 is formed of other thermoplastic resin such as the above-described PC or ABS, other than the one including both PC and ABS resin, similar effects to those in the above-described article of the present invention can be obtained.

What is claimed is:

1. A rotation detecting device comprising:

a case;

an output gear rotatably supported by the case;

a rotating electrode attached to the output gear; and a fixed electrode that is attached to the case and comes into contact with the rotating electrode to detect rotation of the output gear, the output gear including:

a gear main body provided with a gear tooth on an outer edge; and an electrode holding member to which the rotating electrode is attached, the electrode holding member being attached to the gear main body while being rotatably provided in the case, the electrode holding member being formed of at least one thermoplastic resin selected from the group consisting of POM, PA, PBT, PP, PE, ABS resin, PS, PPE, PC, and PMMA, and the gear main body being formed of a material whose strength is higher than the thermoplastic resin of which the electrode holding member is formed, wherein the electrode holding member includes a disk part to which the rotating electrode is attached, and a cylindrical part standing upright on the disk part, wherein the disk part is provided with a plurality of ribs spaced apart in a circumferential direction of the disk part, the plurality of ribs extending in a radial direction of the disk part, and wherein the disk part and the cylindrical part are integrally formed.

2. The rotation detecting device according to claim 1, wherein the gear main body is provided with a fitting receiving part fitted to an outer circumference of the cylindrical part.

3. The rotation detecting device according to claim 1, wherein the disk part is provided with an outer edge rib standing upright on an outer edge of the disk part and extending in the circumferential direction of the disk part.

4. The rotation detecting device according to claim 1, further comprising:

a plurality of fixing projections that are projected from one of the electrode holding member and the gear main body toward the other of the electrode holding member and the gear main body, and are provided spaced apart in a circumferential direction; and at least one fixing depression into which the fixing projections are fitted, the fixing depression being provided on the other of the electrode holding member and the gear main body.

5. The rotation detecting device according to claim 1, further comprising:

an electrode fixing member that is integrally formed with the fixed electrode; and a fix portion to which the electrode fixing member is fitted and fixed, the fix portion being provided in the case.

6. A sheet feeding device comprising:

a tray that houses a recording sheet;

a push-up member that is rotatably attached at one end to a bottom surface of the tray, and rotates in such a manner as to move the other end thereof upward of the tray, thereby pushing the recording sheet upward;

a drive shaft that is rotatably provided in the tray with an interlocking push-up member attached to the drive shaft, the interlocking push-up member being capable of coming into contact with the other end of the push-up member; and a rotation detecting device having an output gear which connects to the drive shaft and is rotated by a driving force of a driving source to rotate the drive shaft, wherein the sheet feeding device includes the rotation detecting device according to claim 1 as the rotation detecting device.

7. An image forming apparatus comprising at least:

a photoconductive drum;

a charging device;

a developing device; and a sheet feeding device, wherein the image forming device includes the sheet feeding device according to claim 6 as the sheet feeding device.

* * * * *